United States Patent [19]

Kemmler et al.

[11] Patent Number: 4,794,841

[45] Date of Patent: Jan. 3, 1989

[54] PNEUMATIC DRIVE MECHANISM FOR POSITIONING APPARATUS

[76] Inventors: Lothar Kemmler, Mozartstr. 4, D6082 Moerfelden, Fed. Rep. of Germany; Norbert Jeschke, Breslauer Strasse 3, D6057 Dietzenbach-Hexenberg, Fed. Rep. of Germany

[21] Appl. No.: 36,665

[22] Filed: Apr. 8, 1987

[30] Foreign Application Priority Data

Apr. 8, 1986 [DE] Fed. Rep. of Germany ..... 3611712
Oct. 31, 1986 [DE] Fed. Rep. of Germany ..... 3637068

[51] Int. Cl.[4] ..... F01B 25/26; F01B 31/12

[52] U.S. Cl. ..... 91/1; 92/5 R; 91/361; 91/454

[58] Field of Search ..... 92/5 R, 130 C; 91/361, 91/364, 454

[56] References Cited

U.S. PATENT DOCUMENTS 3,477,346 11/1969 Slavin et al. ..... 91/361
3,659,499 5/1972 Woodward ..... 91/361

FOREIGN PATENT DOCUMENTS 971648 7/1975 Canada ..... 91/361
2342419 2/1976 Fed. Rep. of Germany ..... 92/5
3042015 5/1982 Fed. Rep. of Germany ..... 91/361

*Primary Examiner*—Robert E. Garrett
*Assistant Examiner*—Thomas E. Denion
*Attorney, Agent, or Firm*—Hill, Van Santen, Steadman & Simpson

[57] ABSTRACT

A pneumatic drive mechanism for use with positioning apparatus or the like, having a drive housing, a drive element such as diaphragm disk, piston or the like, movably seated therein and rigidly connected to a drive rod or similar device. The drive element is responsive to compressed air on one side thereof and to forces from at least one spring operating in opposed action to the compressed air. The spring is arranged within the drive housing. The drive mechanism also has a signal processing device such as a position controller, position encoder, limit signal generator, solenoid valve or i/p converter or similar devices. The signal processing device or devices are integrated within the drive housing in an accomodation space which is free of the spring or springs, of the drive rod and of the drive element.

18 Claims, 5 Drawing Sheets

Fig. 5
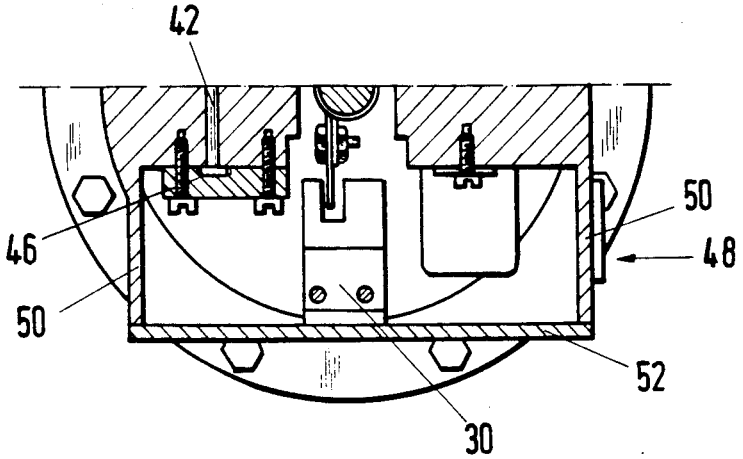
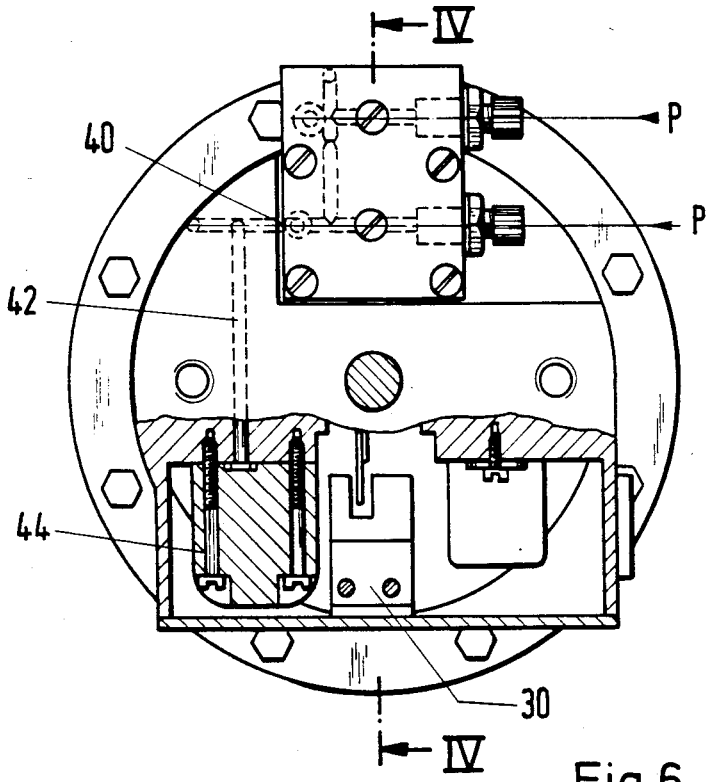
Fig.6

PNEUMATIC DRIVE MECHANISM FOR POSITIONING APPARATUS

BACKGROUND OF THE INVENTION

The present invention in general is directed to a pneumatic drive mechanism for positioning various types of apparatus. More specifically, the pneumatic drive mechanism is of the type having a drive housing which contains a drive element such as a diaphragm disk, a piston or the like, which is movably seated therein and which is rigidly connected to a drive rod or similar mechanism. The drive element is operated with compressed air on at least one side thereof. At least one spring is utilized to provide opposing force on the drive element to the action of the compressed air and is arranged within the drive housing. At least one signal processing device, such as a position controlller, a position encoder, a limit signal generator, a solenoid valve, or a device for converting electrical current signals to pneumatic pressure signals (hereinafter referred to as i/p converters) is also contained within the drive housing.

Pneumatic drive mechanisms of the type set forth above are used for converting the pressure of a pneumatic system into a corresponding physical movement of an apparatus. Such drives serve, for example, for the actuation of a positioning mechanism. In order to achieve a position dependent on the input pressure, the forces of pressure must be balanced against the external forces acting on the drive rod and against the spring force contained within the drive mechanism. A simple acting pneumatic drive to which the invention is especially directed has at least one drive housing, a diaphragm comprising a diaphragm disk or a piston and a drive rod, as well as, a set of springs for establishing intermediate positions of the drive rod in response to the pressure of the pneumatic system. An opposite direction of action may be achieved by reversing the entire drive mechanism as is well known in the art.

Since the external forces which act on the drive rod vary and additional movement-dependent frictional forces may be present, position controllers which allocate a defined path for the input signal in a closed control loop are frequently utilized. Dependent on the execution of the position controller, the input signal can be pneumatic or electric. The position controller is usually attached to the component part to be actuated, for example, to a control valve, being attached thereto as a separate device. However, solutions are also known wherein the position controller is mounted over the drive mechanism in the form of a "disk" or is mounted between the drive mechanism and the component part to be actuated. There are also similar arrangements for other signal processing devices, such as limit signal generators, position encoders, solenoid valves, i/p converters and other auxiliary devices.

SUMMARY OF THE INVENTION

In accordance with an embodiment of the present invention, the signal processing device or devices are located in a module-like structure inside the device housing, and preferably in an upper drive housing section, so that the module forms a part of the drive housing. This module-like fitting involves a particular advantage for the signal processing device or devices. First, it is separated from the drive mechanism as in traditional embodiments to such a degree that the signal processing device can be removed, interchanged or replaced. However, at the same time, no additional space for the signal processing device or devices is required, on the contrary, space hitherto unused in the drive housing can be exploited. The module-like formation of the signal processing device or devices and their respective application as an integrated component part of the housing wall of the device housing also involves the further, special advantage in that the same signal processing devices can be used for drive mechanisms differing in size. The corresponding interfaces or required connections in the drive mechanism can be respectively designed for a signal processing device of the same dimension given drive mechanisms differing in size as will be set forth in greater detail below.

As already discussed above, one of the signal processing devices under consideration is an i/p converter. Given employment of such a converter in a drive mechanism, it is provided in an alternative embodiment that the i/p converter is separated from other signal processing devices. Such a separate provision enables the i/p converter to also be optionally interchanged or replaced.

A problem in prior art pneumatic drive mechanisms of the type referred to above is that signal processing devices require additional space in addition to the actual drive unit formed of the drive housing and the component parts situated therein. Additional costs are also incurred in that the signal processing devices must be accommodated with protection against external influences. Such drive mechanisms should be employable for both a function of "closing" as well as for a function of "opening" without significant outlay in costs insofar as possible. In known drive mechanisms, therefore, a drive rod extends from the housing of the drive mechanism at two locations, so that an element to be actuated is connected to one or the other side of the drive mechanism and is closed or opened in accord with the actuation of the diaphragm drive. Even though this known embodiment of the drive mechanism already represents a straightforward simple structure, this format is not always satisfactory since the drive rod respectively represents a moving part taking up space at one side of which is not utilized.

An object of the present invention is to create a pneumatic drive mechanism of the type which, given the least possible cost outlay, enables a more compact structure than previous prior art arrangements. This object is particularly achieved in that the component parts of the signal-processing systems are reliably protected against external, mechanical damage.

It is a feature of the present invention in that the signal processing device or devices are integrated inside the drive housing and are arranged in an accommodation space adjacent to a spring or springs utilized for the drive rod and for the drive element.

Within the framework of the present invention, the objectives stated above are achieved in that the accommodation space lies between the spring or springs and the inside wall of the drive housing which essentially aligns with the outside circumference of the drive element and is in axial directional alignment with the drive rod.

The invention may also be further characterized by a sensor means within the drive housing acting on the drive element of the drive rod or a component part which is essentially connected thereto. This sensor is utilized for the identification of a measured signal characterizing the respective drive position and for forwarding this measured signal to the signal processing device or devices.

A further feature of the present invention is that, given the pneumatic or electro-pneumatic structure of the signal processing device or devices, exhaust air from an amplifier or from discharge nozzles and, potentially, from the i/p converter floods the accomodation space. This forced flooding of the accomodation space thus protects the signal processing devices from the external atmosphere.

A further embodiment of the invention provides that the accomodation space is in open atmospheric communication with the spring or springs.

Furthermore and given the pneumatic or electro-pneumatic fashioning of the drive mechanism, pneumatic connecting lines are provided between the signal processing device and the i/p converter. These connecting lines are optionally connected to the i/p converter or can be closed off by a terminating part when it is desirable to place the i/p converter in a non-connection state. The drive mechanism under consideration here can thus be optionally equipped with an i/p converter.

In yet another alternative embodiment of the present invention, it is provided that the i/p converter may be removably attached to an outwardly directed surface or wall of an inner housing part and that an outer housing wall in the region of the i/p converter may be partially removable thereby allowing the i/p converter to be removed or interchanged. This provides that the overall drive mechanism need not be dismantled even though the i/p converter is integrated into the drive mechanism. As a result thereof, it is not only possible to initially supply such drive mechanisms without i/p converters and to then equip them with such a converter at a later point in time, but corresponding adjustment work can also be undertaken with particular ease. The advantage also results that an i/p converter of a given size may be utilized for drive mechanisms differing in size.

It is an advantage of the present invention that except for the drive rod there are no movable parts outside of the drive housing, thereby reducing to a considerable degree any sources of malfunction.

The invention further envisions that air lines for the regulating or actuating of the signal processing device or devices may be integrated into the housing parts of the drive housing.

Finally, it can also be provided in accordance with the present invention that the housing parts of the drive housing are fashioned for the acceptance of appropriate apparatus parts and for the acceptance of necessary leads for the signal processing device or devices.

In view of the inadequacies established with the two-sided penetration of the drive mechanism by the drive rod in prior art devices as discussed above, it is provided in the present invention that the drive rod has a connecting end at its region situated inside the drive housing for the attachment of a drive rod continuation and that the opposed end in the upper drive housing has a corresponding, closable opening. Given such an embodiment, the extension of the drive rod through the other end of the housing of the drive mechanism can be selectively delayed until the drive mechanism is in fact determined to execute such a function, that is "opening" or "closing".

In accordance with the present invention, a two-sided or double penetration of the housing of the drive mechanism by the drive rod could be established when the drive mechanism is to fulfill a different function than that for which it had been originally designed. This already establishes a significant advantage over the known drive mechanisms. In order to nonetheless always have only one penetration of the housing of the drive mechanism given such a "re-equipping", it is provided in an alternative embodiment that the drive rod has a further connecting end in the regions of its connection to the drive element for the attachment of a further drive rod continuation and that the lower drive housing has a corresponding, closable opening for the drive rod.

A fastening bushing or a closing part can be introduced into the openings for when the drive rod respectively extends through the opening or does not extend through the opening.

BRIEF DESCRIPTION OF THE DRAWINGS

The features of the invention which are believed to be novel, are set forth with particularity in the appended claims. The invention, together with further objects and advantages, may best be understood by reference to the following description taken in conjunction with the accompanying drawings, in the several figures of which like reference numerals identify like elements, and in which:

FIG. 5 is a partial view in accordance with FIG. 4 cut along the line V—V having connecting lines covered by a cover plate for the connection of an i/p converter;

FIG. 6 is a plan view of the FIG. 4 and FIG. 5 drive mechanism partially cut to illustrate the built-in i/p converters;

DESCRIPTION OF THE PREFERRED EMBODIMENTS

Figure 1:
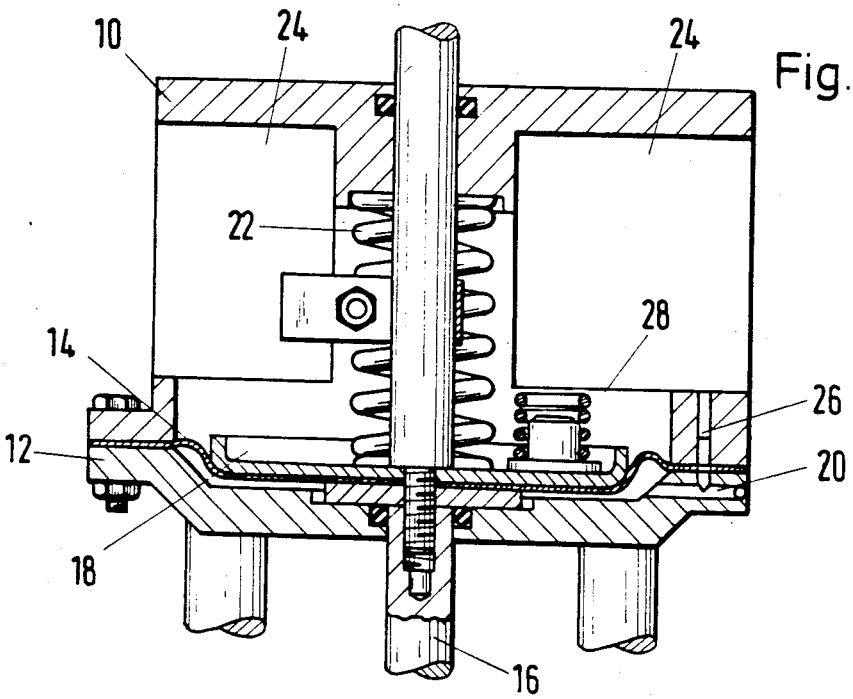
FIG. 1 is an axial, longitudinal sectional view through a drive rod of a pneumatic drive mechanism constructed according to the present invention.
Figure 2:
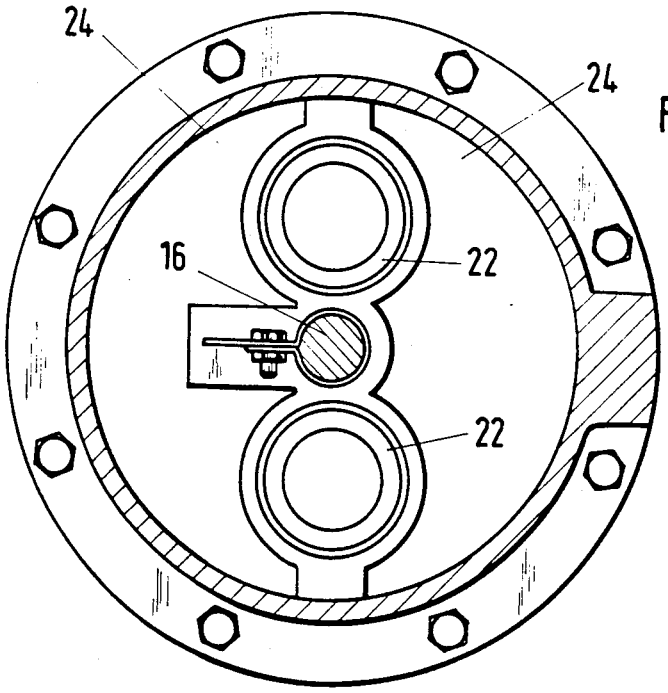
FIG. 2 is a partially cut plan view of the FIG. 1 embodiment.

The present invention has numerous applications but is preferably embodied in a pneumatic drive mechanism of the type shown in FIGS. 1 and 2. The pneumatic drive mechanism has a compression-proof diaphragm 14 arranged within a drive housing composed of two housing parts 10 and 12. This diaphragm 14 is rigidly connected in a known way to a drive rod 16 and to a diaphragm disk 18 and, together with the latter, forms the drive element of the drive mechanism which is axially movable within the housing parts 10 and 12. The side of the diaphragm 14 adjacent the housing part 12 is charged with compressed air via a regulating air channel 26. Two compression springs 22 are arranged at the side of the diaphragm 14 lying opposite the compressed air charging side of the diaphragm 14. The two compression springs 22 are located on either side of the drive rod 16, as shown in FIG. 2. Signal processing devices such as, for example, position controllers, position encoders, limit signal generators, solenoid valves, i/p converters are accommodated in an accommodation space 24 situated at both sides of the springs 22, that is between these springs and the inside wall of the drive housing 10 and 12. For clarity, the signal processing devices are not shown in FIGS. 1 and 2, but may be seen in FIGS. 3 through 8. These signal processing devices will be set forth in greater detail in conjunction with the FIG. 3 description. FIGS. 1 and 2 show that the accommodation space 24 is in communication with the air discharge 20 via a regulating air channel 26. Via a precision measuring spring 28, the distance traversed by the drive elements 14 and 18 or the drive rod 16, can be taken as a measured quantity relative to the housing 10 and 12. Other well-known measuring devices, such as non-contacting devices in electrical apparatus, may be utilized in the embodiment.

Figure 3:
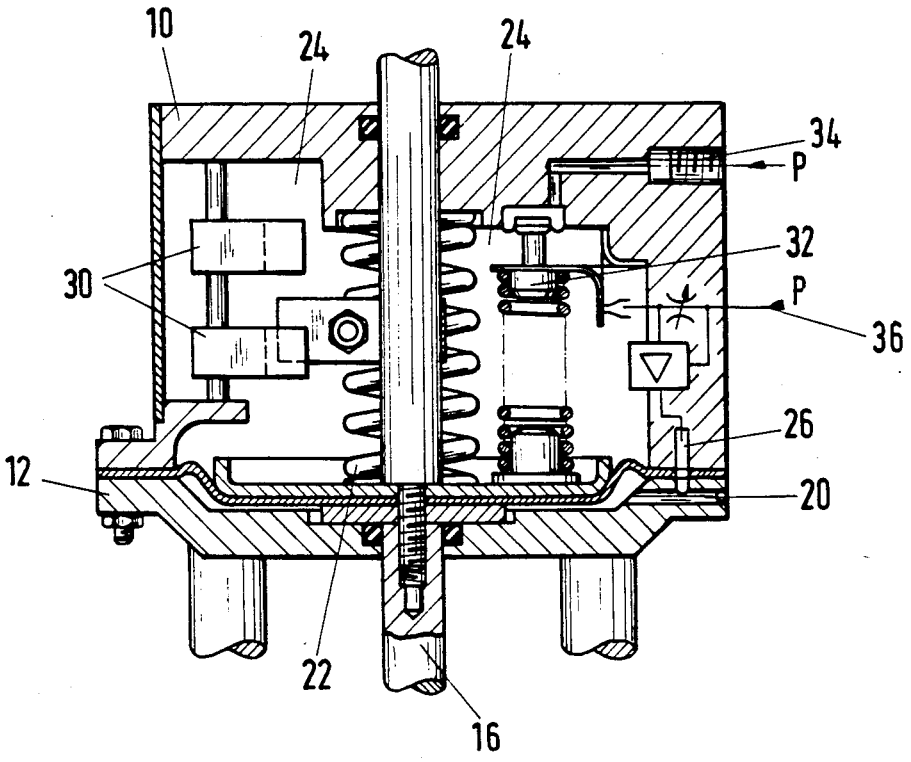
FIG. 3 is an axial longitudinal sectional view of an alternative embodiment of the present invention.

In the FIG. 3 embodiment, inductive limit signal generators 30, as well as, a position controller 32 are integrated into the accommodation space 24 above the diaphragm disk 18 for the identification of the drive position. They function as signal processing devices. The position controller 32 shown schematically in FIG. 3 of the drawings, corresponds to the structure disclosed in German Pat. No. 33 22 166. Similar to the afore-mentioned air discharge 20 for regulating air, the air feeds 34 and 36 for the position controller 32 are integrated in the housing parts 10 and 12.

As a result of the above-described structure of the pneumatic drive mechanism of the present invention, it is an advantage of the present invention that the signal processing devices 30 and 32 are completely integrated into the drive mechanism or drive housing 10 and 12. The accommodation space 24, which is free of the compression springs 22, and which in an axial direction is not substantially greater than an entire length of said spring utilized for the integration. This accommodation space 24 is required neither for the acceptance of the compression spring 22 nor for the drive rod 16 and essentially lies above or, respectively, below the diaphragm 14 in the drive housing with regards to the direction of movement. In addition to a compact structure, the component parts of the signal-processing system, for example, microvalves utilized for small airflows, are protected against external, mechanical influences and sources of damage. The signal processing devices, for example, the limit signal generator 30 and the position controller 32, as shown in FIG. 3, are always flooded by cleaned instrument air in pneumatic and electro-pneumatic devices. This flow of clean instrument air is a result of the corresponding intake or exhaust air through channels in the housing parts 10 and 12. Therefore, the entire spring side of the drive does not need to intake any possibly damaging ambient atmosphere.

No additional housing is needed for the signal processing devices which thereby results in a significant cost savings. No involved mounting and attachment for sensors or similar equipment is necessary at the drive rod 16. On the contrary, the taking of the measured quantity of the distance moved can result directly from the measuring spring 28 within the housing, as shown by way of example in FIG. 1. It is therefore insignificant for the purposes of the present invention whether two or more springs, particularly compression springs 22, be utilized. In any case, the dimensioning of the springs can insure that in accord with the present invention a freely exploitable accommodation space 24 exists. The invention is especially advantageous in single acting pneumatic drive mechanisms as shown in the drawings although the present invention is also applicable to double action drives given the appropriate modification as set forth in the embodiments disclosed herein.

Figure 4:
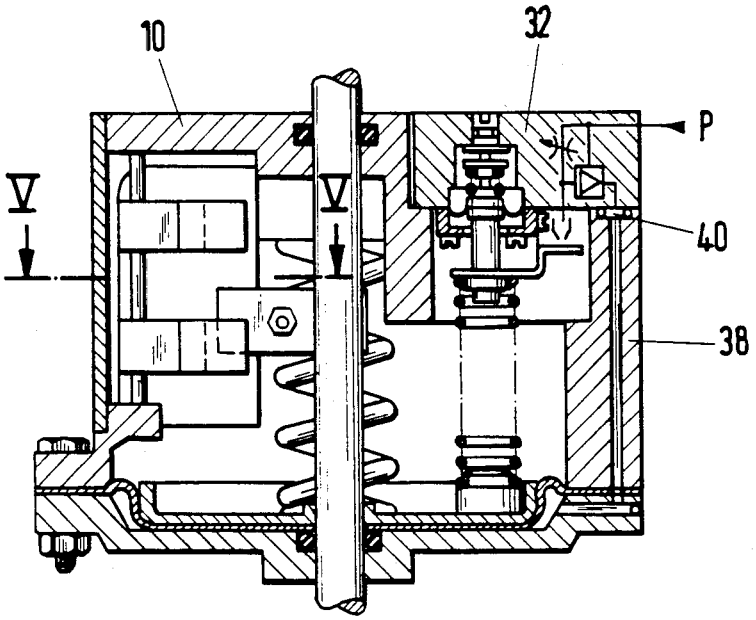
FIG. 4 is a sectional view taken along line IV–V set forth in FIG. 6 showing a drive mechanism with signal processing devices integrated in a module-like portion in a housing wall.

Another alternative embodiment is shown in FIG. 4, wherein a signal processing device in the form of a position controller 32 is fitted into the housing part 10 or, respectively, into a module-like portion 38 so that it forms a part of the drive housing 10. As may be seen, in conjunction with FIG. 6, suitable interfaces 40 are fashioned in the housing part 10. Thus, the position controller 32 can, first, be freely built in or dismantled and, second, may be connected in an integrated fashion to the drive mechanism, thereby resulting in the advantages set forth above for the present invention.

Also in the alternative embodiments shown in FIGS. 5 and 6, respective pneumatic connecting lines 42 are provided which enable a separate attachment if the i/p converter 44 shown in FIG. 6. In the illustration of FIG. 5, a closing part 46 is provided instead of the i/p converter 44, the pneumatic connecting line 42 being covered with this closing part 46 is utilized in the situation shown in FIG. 5 wherein an i/p converter is not provided in the drive mechanism.

Further, a special embodiment of the housing of the drive mechanism is depicted in FIGS. 5 and 6. Departing from the otherwise circular cross-section, the housing of the drive mechanism comprises a box-like, formed-out portion 48 at one side. This is composed of two sidewalls 50 proceeding roughly tangiently out of the circular cross-section and of a closing cover 52. The closing cover 52 is detachably secured to the sidewalls 50 so that the cover part 46 can be easily interchanged with an i/p converter 44 after removal of the closing cover 52. Utilization of the closing cover 52 also allows for replacement of an existing i/p converter when necessary.

Furthermore, FIGS. 5 and 6 also show the limit signal generators 30 similar to those shown in FIG. 3.

Figure 7:
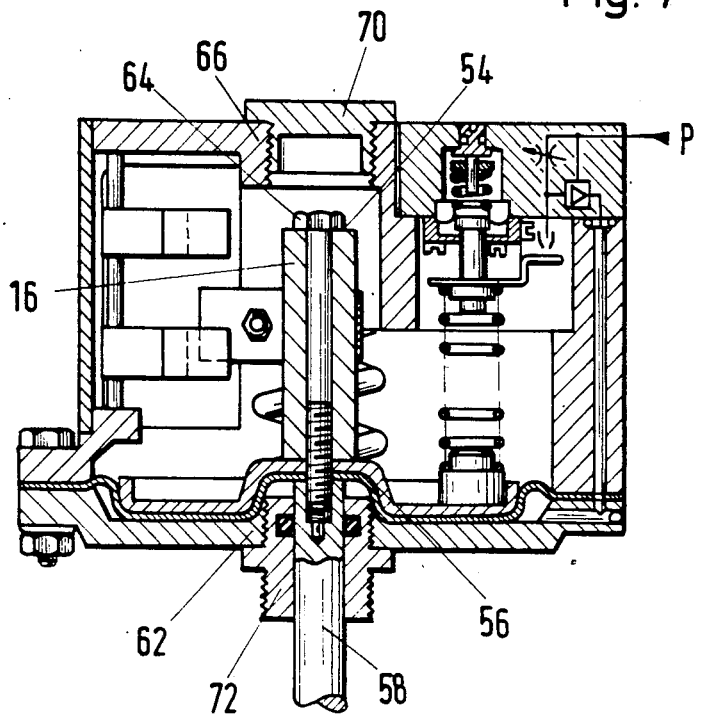
FIG. 7 is a cross-sectional view of a drive mechanism illustrating the drive rod continuation depicting the function of "closing"
Figure 8:
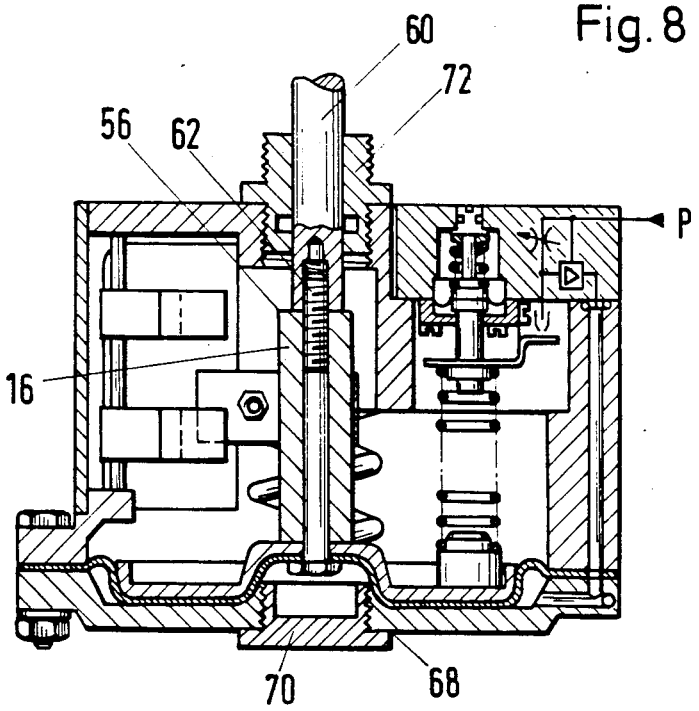
FIG. 8 is a sectional view of the FIG. 7 drive mechanism depicting the drive rod continuation functioning as "opening".

FIGS. 7 and 8 show another alternative embodiment of a drive mechanism of the present invention which has a drive rod 16 which has two connecting ends 54 and 56 to which drive rod continuations 58 and 60 are respectively connected. The connecting ends 54 and 56 and the drive rod continuations 58 and 60 are each provided with a threaded bore in their end region into which a connecting screw 62 can be respectively engaged. If one of the connecting ends 54 or 56 is not connected to a drive rod continuation, that connecting end may be respectively closed with a breech screw 64. In such a case wherein a drive rod continuation 58 or 60 does not penetrate the opening 66 or 68, the two openings 66 or 68 in the housing part 10 or 12, respectively, are closed with a closing part 70. In the situation where a drive rod continuation 58 or 60 penetrates an opening 66 or 68, respectively, a fastening bushing 72 is provided in the opening 66 or 68. As shown in FIG. 7 and FIG. 8, the respective housing part 10 or 12 is provided with a corresponding inside threading at the openings 66 and 68 and that the closing part 70 or the fastening bushing 72 is provided with a corresponding outside thread for engagement.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

We claim:

1. Pneumatic drive mechanism for positioning apparatus comprising:

drive housing having at least one accommodation space;

drive element movably seated in said drive housing;

drive rod rigidly connected to said drive element;

means for supplying compressed air to at least one side of said drive element;

at least one spring arranged within said drive housing and operatively connected to said drive element to apply a force on said drive element opposite to a force on said drive element from said compressed air;

at least one means for signal processing integrated within said drive housing in said accommodation space, said accommodation space lying between said spring and an inside wall of said drive housing aligning essentially with an outside circumference of said drive element in an axial direction of said drive rod, said accommodation space in an axial direction being not substantially greater than an entire length of said spring.

2. The mechanism described in claim 1, wherein said means for signal processing is contained module-like in said drive housing and forms a part of said drive housing.

3. The mechanism described in claim 1, wherein said mechanism has at least two means for signal processing and wherein one of said means for signal processing is an i/p converter separated from a second means for signal processing.

4. The mechanism described in claim 3, wherein said mechanism further comprises pneumatic connecting lines between said i/p converter and said second means for signal processing, said pneumatic connecting lines being selectively connectable to said i/p converter, said mechanism also having a closing part attached to an end of said pneumatic connecting lines when said i/p converter is not connected to said pneumatic connecting lines.

5. The mechanism described in claim 1, wherein said mechanism further comprises at least two means for signal processing within said drive housing, one of said means for signal processing being a means for sensing drive position of said drive rod and coupled to said drive element, said means for sensing drive position producing a measured signal representative of the drive position of said drive rod and forwarding said measured signal to said other means for signal processing.

6. The mechanism described in claim 1, wherein said accommodation space is flooded with exhaust air from said means for signal processing which is of a pneumatic type, as well as, exhaust air of an amplifier and discharge nozzles contained in said drive housing.

7. The mechanism described in claim 1, wherein said accommodation space is in open atmospheric communication with said spring.

8. The mechanism described in claim 1, wherein said mechanism further comprises air lines for regulating air flow for use by said means for signal processing and are integrated in housing parts of said drive housing.

9. The mechanism described in claim 1, wherein said drive housing comprises at least two housing parts which have means for providing communication between a plurality of means for signal processing.

10. The mechanism described in claim 1, wherein said drive housing has first and second opposed closeable openings in upper and lower halves, respectively thereof, and said drive rod has a first connecting end at a region located inside of said upper half of said drive housing for the attachment of a drive rod continuation, said drive rod continuation extending through said first closeable opening.

11. The mechanism described in claim 1, wherein said drive rod further has a second connecting end in a region of said drive rod connection to said drive element for the attachment of a further drive rod continuation.

12. The mechanism described in claim 10, wherein said mechanism further comprises a fastening bushing insertable into said closeable opening through which said first drive rod continuation extends and a closing part for sealing said second closeable opening through which said drive rod continuation does not extend.

13. Pneumatic drive mechanism for positioning apparatus comprising:

drive housing having at least one accommodation space;

drive element movably seated in said drive housing;

drive rod rigidly connected to said drive element;

means for supplying compressed air to at least one side of said drive element;

at least one spring arranged within said drive housing and operatively connected to said drive element to apply a force on said drive element opposite to a force on said drive element from said compressed air;

at least one means for forming a module located substantially in said accommodation space in said drive housing and forming a part of said drive housing, said accommodation space lying between said spring and an inside wall of said drive housing aligning essentially with an outside circumference of said drive element in an axial direction of said drive rod, said accommodation space in an axial direction being not substantially greater than an entire length of said spring; and at least one means for signal processing substantially integrated with said module means in said drive housing.

14. The mechanism described in claim 13, wherein said mechanism has at least two means for signal processing and wherein one of said means for signal processing is an i/p converter separated from a second means for signal processing, and wherein said mechanism further comprises pneumatic connecting lines between said i/p converter and said second means for signal processing, said pneumatic connecting lines being selectively connectable to said i/p converter, said mechanism also having a closing part attached to an end of said pneumatic connecting lines when said i/p converter is not connected to said pneumatic connecting lines.

15. The mechanism described in claim 13, wherein said mechanism further comprises at least two means for signal processing within said drive housing, one of said means for signal processing being a means for sensing drive position of said drive rod and coupled to said drive element, said means for sensing drive position producing a measured signal representative of the drive position of said drive rod and forwarding said measured signal to said other means for signal processing.

16. Pneumatic drive mechanism for positioning apparatus comprising:

drive housing having at least one accommodation space;

drive element movably seated in said drive housing;

drive rod rigidly connected to said drive element;

means for supplying compressed air to at least one side of said drive element;

at least one spring arranged within said drive housing and operatively connected to said drive element to apply a force on said drive element opposite to a force on said drive element from said compressed air;

at least one means for signal processing integrated within said drive housing in said accommodation space, said accommodation space lying between said spring and an inside wall of said drive housing aligning essentially with an outside circumference of said drive element in an axial direction of said drive rod, said accommodation space in an axial direction being not substantially greater than an entire length of said spring and said accommodation space flooded with clean instrument air.

17. The mechanism described in claim 16, wherein said mechanism has at least two means for signal processing and wherein one of said means for signal processing is an i/p converter separated from a second means for signal processing, and wherein said mechanism further comprises pneumatic connecting lines between said i/p converter and said second means for signal processing, said pneumatic connecting lines being selectively connectable to said i/p converter, said mechanism also having a closing part attached to an end of said pneumatic connecting lines when said i/p converter is not connected to said pneumatic connecting lines.

18. The mechanism described in claim 16, wherein said mechanism further comprises at least two means for signal processing within said drive housing, one of said means for signal processing being a means for sensing drive position of said drive rod and coupled to said drive element, said means for sensing drive position producing a measured signal representative of the drive position of said drive rod and forwarding said measured signal to said other means for signal processing.

* * * * *